US005259219A

United States Patent [19]

Dausch et al.

[11] Patent Number: 5,259,219

[45] Date of Patent: Nov. 9, 1993

[54] SENSOR HOLDER FOR A MACHINE FOR CLEANSING ARTICLES

[75] Inventors: Mark E. Dausch, Schenectady; Donald T. McGrath, Scotia; Walter Whipple, III, Amsterdam; Terry C. Cooper, Schenectady, all of N.Y.

[73] Assignee: General Electric Company, Schenectady, N.Y.

[21] Appl. No.: 877,310

[22] Filed: May 1, 1992

[51] Int. Cl.[5] ..... D06F 39/08

[52] U.S. Cl. ..... 68/207; 68/12.02; 68/12.19; 137/561 A

[58] Field of Search ..... 68/12.02, 12.19, 207; 134/57 D, 113; 137/561 A; 356/440, 442

[56] References Cited

U.S. PATENT DOCUMENTS 3,613,405 10/1971 Shimokuso et al. ..... 68/12.02
5,048,139 9/1991 Matsumi et al. ..... 68/12.02 X
5,136,861 8/1992 Kiuchi et al. .

FOREIGN PATENT DOCUMENTS 274797 11/1989 Japan .
77296 3/1990 Japan .

*Primary Examiner*—Philip R. Coe
*Attorney, Agent, or Firm*—James R. McDaniel; Paul R. Webb, II

[57] ABSTRACT

This invention relates to a holder for turbidity sensors of the type used in machines for cleansing articles. Such structures of this type, generally, allow the turbidity of the liquid employed in the cleansing of the articles to be accurately measured without affecting the performance capacity of the sensor.

6 Claims, 1 Drawing Sheet

SENSOR HOLDER FOR A MACHINE FOR CLEANSING ARTICLES

CROSS REFERENCE TO RELATED APPLICATIONS

This application is related to U.S. patent applications Ser. No. 07/877,302, filed on May 1, 1992, entitled A Fuzzy Logic Control Method for Reducing Energy Consumption in a Machine for Washing Articles, by Dausch et al. and Ser. No. 07/877,303, filed on May 1, 1992, entitled "Machine for Cleansing Articles", by Molnar et al.

BACKGROUND OF THE INVENTION

1. Field of the Invention

This invention relates to a holder for turbidity sensors of the type used in machines for cleansing articles. Such structures of this type, generally, allow the turbidity of the liquid employed in the cleansing of the articles to be accurately measured without affecting the performance capacity of the sensor.

2. Description of the Related Art

Reducing the amount of energy consumed by a machine for cleansing articles, such as a clothes washer, is a significant problem, in part because of increasing energy costs. In such machines, the amount of energy consumed is primarily determined by the amount of energy needed to heat the water used to wash the articles. Thus, decreased water consumption for such machines may result in a significant and permanent energy efficiency.

Appliances for washing articles, such as clothes washers, are typically preprogrammed to perform a complete washing in a predetermined number of wash cycles, each wash cycle having a predetermined duration. A wash cycle may comprise the separate operation steps of providing substantially particle-free water to the frame (fill cycle), circulating the water during the wash cycle (circulation cycle), and draining or flushing the water from the frame after the water is used to wash the articles (drain cycle). Usually, though, the machine user may only select from the limited number of preprogrammed options. Such pre-programming does not use energy efficiently because the machine often performs an excessive number of wash cycles, each cycle for an excessive duration, to assure that cleanliness of the articles is achieved. To improve the energy efficiency of such machines, closed loop feedback control has been introduced. Several techniques are available to indirectly monitor cleanliness of the articles during closed loop feedback control of the appliance including use of a device for measuring the turbidity of water used to wash the articles.

Devices for measuring turbidity that detect the transmission of light propagated through the water used to wash the articles have been employed to ascertain the information about the progress of the wash. However, these devices are not ideal for use in household appliances. Such devices are often times difficult or non-economic to implement due to the complex electronic circuitry necessary to perform the complex turbidity measurements. Furthermore, such devices are subject to measurement error. Factors such as water turbulence, cloudiness of the water sample chamber, light source dimming, or device performance degradation may cause attenuation of the amount of light detected and thus, effect measurement accuracy. The precision of such devices is also not entirely satisfactory. This imprecision has the additional effect of making turbidity measurements provided by such devices difficult to interpret in a closed loop feedback control system.

Finally, the location of the sensor is also of key importance. It is known in clothes washers to locate the sensor either in the overhead spray arm hose where water is being fed into the machine or in the drain hose where the water or effluent is being drained from the machine. In either of these two instances, the turbulence of the water adversely affects the performance characteristics of the sensor because bubbles that are created by the water turbulence may provide a false read in the sensor. This is because the bubbles affect the light measuring characteristics of the sensor. Therefore, a reduction in the affect of the composition of the water would be advantageous.

It is apparent from the above that there exists a need in the art for a turbidity sensor holder which is capable of measuring the turbidity of the fluid used in cleansing the articles, and which at least equals the measurement characteristics of known turbidity sensors, but which at the same time is not adversely affected by the composition of the cleansing fluid. It is a purpose of this invention to fulfill this and other needs in the art in a manner more apparent to the skilled artisan once given the following disclosure.

SUMMARY OF THE INVENTION

Generally speaking, this invention fulfills these means by providing a turbidity sensor holder system for a machine for cleansing articles, comprising a container means having first and second ends and rigidly attached to an outer wall of said machine for cleansing articles, a reservoir means substantially located within said container means, a fluid passage means substantially located on said outer wall and adjacent to said first end of said container means, a reservoir inlet means located adjacent to said first end of said container means, a reservoir outlet means located adjacent to said second end of said container means and at a predetermined distance away from said reservoir inlet means, a turbidity sensor means located at a predetermined distance away from said reservoir outlet means, a fluid outlet means located adjacent to said outer wall of said machine, and a fluid conduit means which fluidly interconnects said reservoir outlet means, said turbidity sensor means, and said fluid outlet means.

In certain preferred embodiments, the fluid passage means includes holes and chamfers that allow water to pass to and from the inside of the article cleansing machine. Also, the turbidity sensor is located such that the water and bubbles flow upward through the sensor. Also, the reservoir is located with respect to the fluid passage means so that when water is coming in through the reservoir inlet means, this should clear out any debris found in the fluid passage means and when water is flowing through the fluid passage means, as in the case when the machine is performing its circulation cycle, the turbidity of this water can be accurately measured by the sensor. Finally, when the article cleansing machine is performing the fill cycle, the sensor is able to self-calibrate itself and determine the turbidity of the particle-free water before the turbidity of the "dirty" water is determined.

In another preferred embodiment, the turbidity of the water can be accurately measured without the composition of the water adversely affecting the sensor performance.

The preferred sensor holder, according to this invention, offers the following advantages: easy assembly and repair; good stability; good durability; excellent turbidity measurement characteristics; good economy; reduced affect due to cleansing fluid composition; and high strength for safety. In fact, in many of the preferred embodiments, these factors of improved sensor characteristics and reduced fluid composition affect are optimized to an extent that it is considerably higher than heretofore achieved in prior, known sensor holders.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Figure 1:
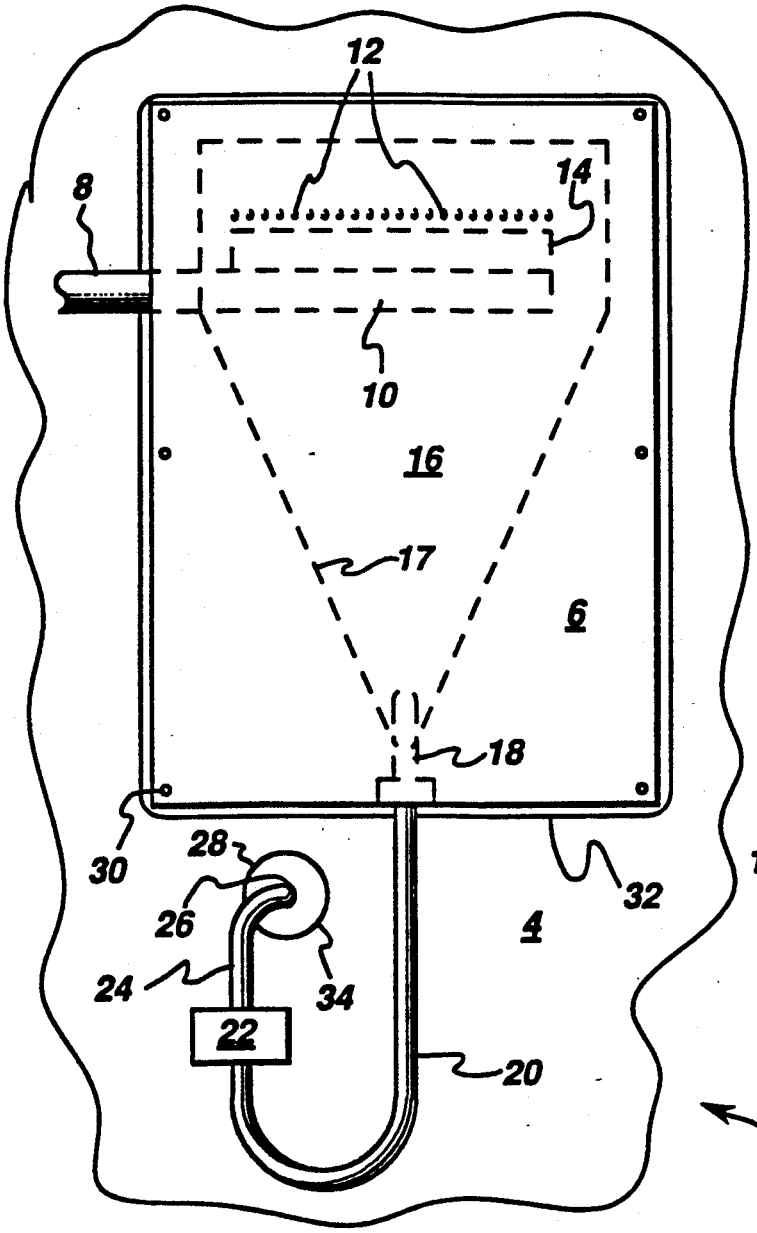
FIG. 1 is a front view of a turbidity sensor holder, according to the present invention.

With reference first to FIG. 1, there is illustrated sensor holder system 2 which is rigidly attached to the outer wall 4 of a conventional article cleansing machine (not shown). System 2 includes in part reservoir container 6, conventional water inlet 8, manifold 10, holes 12 having chamfers 13 and 15 which are located on the outer wall 4, manifold outlet 14, reservoir 16, reservoir walls 17, reservoir outlet 18, conventional conduit tubing 20 and 24, turbidity sensor 22, conduit mount 28 having a hole 26, conventional fasteners 30 and hole 34 located on outer wall 4. Reservoir container 6, preferably, is constructed of any suitable polymeric material, such as, polypropylene. Manifold 10, manifold outlet 14, and outlet 18, preferably, are machined in reservoir container 6 by conventional machining techniques. Walls 17 are angled with respect to the outer walls of container 6 so that any debris that enters reservoir 16 will traverse down long walls 17 and out through outlet 18. The angle of the walls 17 should be such that the debris does not build up and avalanche down to outlet 18 and plug up outlet 18. Conduits 20 and 24 preferably are constructed of any suitable polymeric or elastomeric material. Sensor 22 includes the turbidity measuring device as disclosed in U.S. patent application Ser. No. 07/877,303 by Molnar et al., entitled "Machine for Cleansing Articles" and is hereby incorporated by reference. It is to be understood that other types of sensors can be used as sensor 22 such as a conventional conductivity sensor or a conventional Ph sensor. Conduit 20 is rigidly attached to outlet 18 and sensor 22 by conventional fasteners (not shown). Conduit 24 is rigidly attached to sensor 22 and hole 26 in outlet 28 by conventional fasteners (not shown). Container 6 is rigidly attached to outer wall 4 by conventional fasteners 30.

Figure 2:
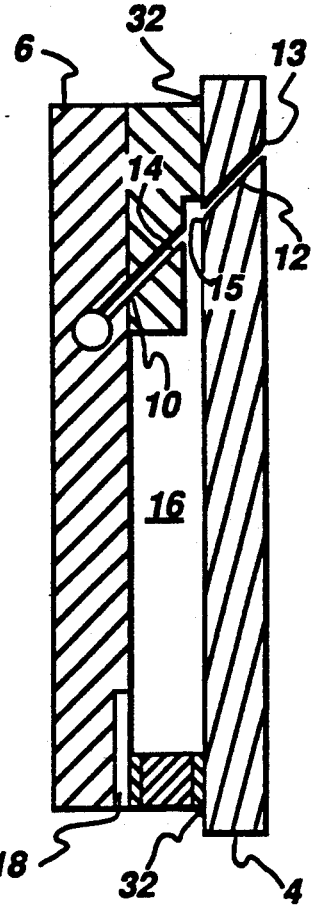
FIG. 2 is a side plan view of the turbidity sensor reservoir container.

With respect to FIG. 2, the rigid attachment of holder 2 to outer wall 4 can be more clearly seen. In particular holder 2 is rigidly attached to outer wall 4 by conventional sealant/adhesive 32. Also, with respect to FIG. 2 it can be seen that manifold outlet 14 is spaced at a predetermined distance away from holes 12 and outer wall 4. Finally, chamfers 13 and 15 in hole 12 can be more readily seen. Chambers 13 and 15 are formed in holes 12 by conventional machining techniques.

With respect to the operation of system 2, a machine for cleansing articles, such as a dishwater, typically, operates over three separate steps of operation or cycles. These cycles being the fill cycle, the circulation cycle and the drain cycle. The fill cycle is usually first and the drain cycle is usually the last cycle. During the operation of system 2, substantially particle-free water is introduced from a water source (not shown) through inlet 8 such that the water enters through manifold 10 and is forced out of manifold outlet 14. As the water is forced out of outlet 14, the water contacts holes 12 through chamfers 15 and outer wall 4. The purpose of this contact is to loosen any debris, such as, food matter, that may have been lodged in holes 12 during the last cycle of operation. As water contacts holes 12, some of the water contacts the area between holes 12 and falls down into reservoir 16 and reservoir 16 begins to fill up. At this time, water also begins to run through conduit 20, pass turbidity sensor 22 and out through conduit 24 into hole 26 of outlet 28 and in a short period of time reservoir 16 is completely filled up. Once reservoir 16 is completely filled up, the pressure of the water leaving outlet 14 causes the water pressure in reservoir 16 to increase rapidly. This rapid increase in water pressure in reservoir 16, causes the water to rapidly move through conduit 20 which should flush out any debris in sensor 22. During this part of the fill up of the machine, sensor 22 is able to clean and self-calibrate itself with the use of a conventional controller (not shown) in order to more accurately determine the turbidity of this relatively particle-free water. Also, the increased water pressure during the fill up cycle should cause any debris located in reservoir 16 to be forced down to outlet 18 and out of reservoir 16.

Once the article cleansing machine has ended its fill up cycle, the circulation cycle begins. During this part of the cycle water from the machine enters into holes 12 along chamfers 13 and flows into reservoir 16. This water from reservoir 16 then passes along through sensor 22 and out through hole 26 of outlet 28. During this circulation cycle, the sensor should measure the turbidity of the water.

Finally, during the pump out cycle, all the water is drained from holder system 2. Once the pump out cycle is completed, the fill up cycle may begin again if the predetermined level of turbidity in the water has not yet been achieved. Typically, the three operation cycles are performed for approximately seven or eight times until the predetermined turbidity level is achieved.

It is noted that the location of the sensor with respect to the curvature of conduit 20 is important. As discussed earlier, the operation of the article cleansing machine creates a large amount of turbulence in the cleansing fluid or water. This turbulence results in bubbles of various sizes being formed in the cleansing fluid or water. If these bubbles are not eliminated from the region where the sensor 22 is performing the turbidity measurement, the accuracy of the turbidity measurement may be adversely affected. Consequently, water from conduit 20 should flow upward through sensor 22 in order to keep the bubbles moving through sensor 22. If the bubbles were allowed to stop within sensor 22, this may affect the turbidity measurement of sensor 22.

It is also to be understood that the configuration of reservoir 16 is of key importance. Reservoir 16 must include slanted walls 17. Walls 17 are slanted in order to keep the larger size bubbles of the fluid from entering outlet 18. In this manner, only the smaller sized bubbles will enter into sensor 22. As discussed earlier, the upward flow of the fluid through sensor 22 substantially removes any adverse effects that the smaller bubbles may have on the turbidity measurement of sensor 22.

Finally, the holes 12 include chamfers 13 and 15 in order to properly assist the removal of debris from holes 12. In particular, as the article cleansing machine is performing the fill up cycle, water contacts holes 12 near chamfer 15 and pushes any debris in holes 12 back through outer wall 4 and into the article cleansing machine where the debris is typically taken up by the sump pump (not shown). During the circulation cycle, water contacts chamfers 13 and holes 12 and debris which is too large for outlet 18 should either become lodged in holes 12 or fall back into the inside of the article cleansing machine where the debris is usually taken up by the sump pump. When the subsequent fill up cycle is performed, the lodged debris is then pushed back into the machine and is taken up by the sump pump.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A turbidity sensor holder system for a machine for cleansing articles, wherein said holder is comprised of:

a container having first and second ends and rigidly attached to an outer wall of said machine for cleansing articles;

a reservoir substantially located within said container;

a fluid passage substantially located on said outer wall and adjacent to said first end of said container;

a reservoir inlet located adjacent to said first end of said container;

a reservoir outlet located adjacent to said second end of said container and at a predetermined distance away from said reservoir inlet;

a turbidity sensor located at a predetermined distance away from said reservoir outlet;

a fluid outlet located adjacent to said outer wall of said machine; and a fluid conduit which fluidly interconnects said reservoir outlet, said turbidity sensor, and said fluid outlet.

2. The holder system, according to claim 1, wherein said container is further comprised of:

a manifold located at a predetermined distance away from said fluid passage.

3. The holder system, according to claim 1, wherein said fluid passage is further comprised of:

a tubular opening having at least one chamfer located adjacent to an end of said tubular opening.

4. The holder system, according to claim 1, wherein said reservoir is further comprised of:

an angled wall located between said reservoir inlet and said reservoir outlet.

5. The holder system, according to claim 1, wherein said fluid conduit is further comprised of:

first, second, third and fourth ends.

6. The holder system, according to claim 5, wherein turbidity sensor is substantially located between said second and said third ends of said fluid conduit such that said third end is located substantially above said second end.

* * * * *